US005742875A

United States Patent [19]

Bogoshian et al.

[11] Patent Number: 5,742,875

[45] Date of Patent: Apr. 21, 1998

[54] ROLL SEAL BLADE SUPPORT FOR A XEROGRAPHIC DEVELOPMENT UNIT USING MAGNETIC TONER

[75] Inventors: Gregory V. Bogoshian, Rochester; Raphael F. Bov, Jr., Pittsford, both of N.Y.

[73] Assignee: Xerox Corporation, Stamford, Conn.

[21] Appl. No.: 797,071

[22] Filed: Feb. 10, 1997

[51] Int. Cl.[6] ..... G03G 15/08

[52] U.S. Cl. ..... 399/104

[58] Field of Search ..... 399/104, 272, 399/274, 275

[56] References Cited

U.S. PATENT DOCUMENTS

| | | | |
|---|---|---|---|
| 4,596,455 | 6/1986 | Kohyama et al. | 355/3 DD |
| 5,072,690 | 12/1991 | Ishikawa et al. | 399/275 |
| 5,084,733 | 1/1992 | Katoh et al. | 399/104 |
| 5,134,960 | 8/1992 | Shirai | 399/105 |
| 5,187,326 | 2/1993 | Shirai | 118/657 |
| 5,287,148 | 2/1994 | Sakemi et al. | 399/104 |
| 5,450,169 | 9/1995 | Hart et al. | 355/215 |
| 5,563,689 | 10/1996 | Tompkins et al. | 399/272 |

*Primary Examiner*—Matthew S. Smith
*Attorney, Agent, or Firm*—R. Hutter

[57] ABSTRACT

In a xerographic development unit, particularly a unit for applying single-component magnetic toner such as used in MICR printing, the end of a donor roll which applies toner to the surface of a charge receptor is provided with a magnetic seal. The magnetic seal extends around at least a portion of the circumference of the roll, and defines a set of alternating magnetic poles arranged in bands which alternate along the length of the roll. The magnetic seal forms a uniform gap relative to the surface of the roll, the gap being sufficiently large to allow a turnover of toner particles therethrough. The design minimizes mechanical stresses on the toner, which in turn avoids the generation of frictional heat in the toner. A member defining magnetic poles can also be used as a shim for mounting a charge/metering blade within the development unit.

5 Claims, 2 Drawing Sheets

FIG. 1
PRIOR ART
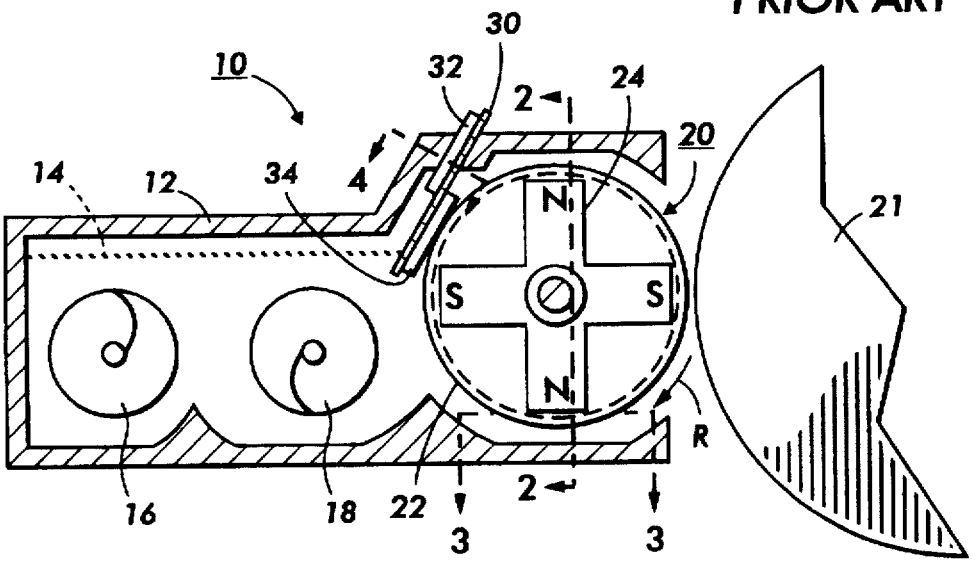
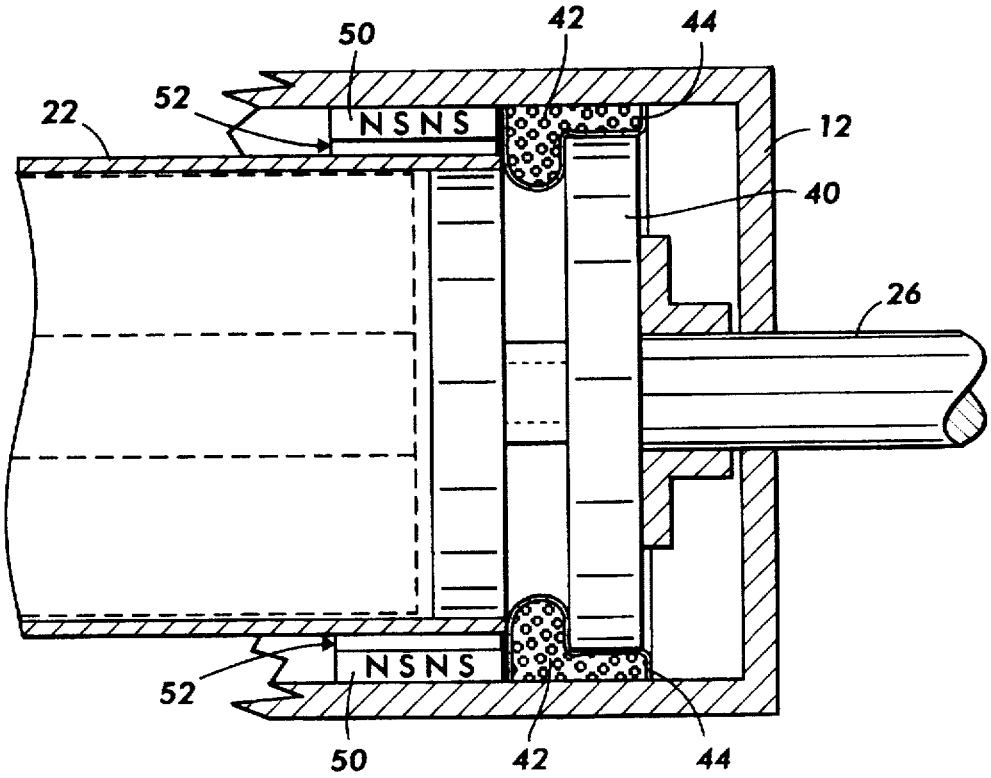
FIG. 2

ROLL SEAL BLADE SUPPORT FOR A XEROGRAPHIC DEVELOPMENT UNIT USING MAGNETIC TONER

FIELD OF THE INVENTION

The present invention relates to xerographic development units which apply magnetic toner to an electrostatic latent image. More specifically, the present invention relates to a roll seal and a blade support for use in such a development unit.

BACKGROUND OF THE INVENTION

In the well-known process of xerography, or electrophotographic printing, a charge retentive surface, known as a photoreceptor, is electrostatically charged, and then exposed to a light pattern of an original image to selectively discharge the surface in accordance therewith. The resulting pattern of charged and discharged areas on the photoreceptor form an electrostatic charge pattern, known as a latent image, conforming to the original image. The latent image is developed by contacting it with a finely divided electrostatically attractable powder, known as "toner." Toner is held on the image areas by the electrostatic charge on the photoreceptor surface. Thus, a toner image is produced in conformity with a light image of the original being reproduced. Subsequent to development, excess toner left on the charge retentive surface is cleaned from the surface. The process is useful for light lens copying from an original or printing electronically generated or stored originals such as with a raster output scanner (ROS), where a charged surface may be imagewise discharged in a variety of ways.

In the process of electrophotographic printing, the step of conveying toner to the latent image on the photoreceptor is known as "development." The object of effective development of a latent image on the photoreceptor is to convey toner particles to the latent image at a controlled rate so that the toner particles effectively adhere electrostatically to the appropriately-charged areas on the latent image.

A commonly used development technique involves a single-component developer material. In a typical single-component development system, each toner particle has both magnetic properties (to allow the particles to be magnetically conveyed to the photoreceptor) and an electrostatic charge (to enable the particles to adhere to the photoreceptor). In such a system, the developer roll is in the form of a cylindrical sleeve which rotates about a stationary magnet assembly. The magnetized toner particles adhere to the rotating sleeve by the force of the stationary magnets within the sleeve. As the sleeve rotates around the magnets, particles adhering to the sleeve are exposed to an alternating series of magnetic polarities.

A charge/metering or C/M blade contacts the toner particles on the sleeve along one longitude of the developer roll. The C/M blade performs two simultaneous functions: it allows a uniform metered layer of toner to pass underneath, and uniformly charges the toner that is metered by mechanical means. That is, the action of the toner particles rubbing against the blade and each other while being metered by the blade induces a charge on the toner particles, much in the manner of rubbing a balloon against a wool cloth. The uniformity of the nip formed between the blade and the developer roll plays a significant role in creating a uniform charge of toner across the development roll. "Charge sharing" among particles, charge polarity, and charge level are also controlled through the use of charge control additives loosely attached to the surface of the toner particles.

When this thin layer of uniformly-charged particles is obtained, the developer roll advances the toner particles to a development zone adjacent the surface of the photoreceptor. In the development zone, the toner particles adhering magnetically to the developer roll are attracted electrostatically to the latent image recorded on the photoreceptor. AC and DC biases may be applied to the donor roll to enhance and control this process.

Single-component developers which are comprised mainly of toner particles having magnetic properties are particularly useful in a special segment of the electrophotographic printing market, the creation of magnetic ink character recognition (MICR) documents, where the ink or toner forming the characters has magnetic properties. As is well known, MICR characters such as appear on checks are printed in special fonts by which each character creates a signature pattern of magnetic flux which can be recognized by a recognition program when the characters are run past a magnetic read head. Thus, in a single-component development system, the same magnetic properties which enable the toner to be conveyed around a developer roll are also useful for creating the magnetic properties of the characters on a sheet.

In any type of development unit, a major practical concern is the design of the "roll seal," a sealing structure around the support on which rolls within the development unit are supported. These roll seals are the site of major design concerns, particularly leakage of toner and other material out of the development unit into the rest of the machine, and also the generation of frictional heat, which has a serious effect on the electrostatic performance of the toner. MICR single-component developers typically contain additives such as titanium dioxide and powder flow enhancement additives such as that known under the tradename "Aerosil," and so frictional heat generated around the roll seal in a development unit can be destructive of the performance of MICR toner. In particular, frictional heat generated in the development unit causes agglomeration, or "clumping," of the MICR toner within the development unit. These agglomerates, should they be trapped between the C/M blade and the donor roll, will create bands of non-uniformly charged toner on the donor roll, leading to non-uniform development of the latent image; also, the trapped agglomerates will cause areas of high wear on the donor roll. It is therefore important to avoid such agglomeration, and a preferred technique for avoiding agglomeration is to prevent frictional heat from concentrating on any given quantity of toner within the development unit.

DESCRIPTION OF THE PRIOR ART

In the prior art, U.S. Pat. No. 4,596,455 discloses a xerographic developing apparatus in which magnetic particles within the developer, which may be carrier beads or magnetized toner particles, are caused to accumulate toward one end of the developer roll, thereby forming a "shield" which prevents toner from leaking out. Permanent magnets placed toward the end of a blade or a roll create a concentration of the magnetic particles at the end of the roll.

U.S. Pat. No. 5,187,326 discloses a developing unit in which a magnetic sealing member outside a developer roll cooperates with magnets within the developer roll to create a magnetic brush of the developer between the magnetic sealing member and the roll, so that the magnetic particles form a seal at the end of the roll.

U.S. Pat. No. 5,450,169 discloses a roll seal for a developing unit, including a magnetic member extending around the circumference of a rotating member. The magnetic member includes a plurality of magnetic poles with magnetic axes extending in a direction substantially perpendicular to the axis of the member. The poles alternate north to south along the length of the member. The arrangement forms a curtain of carrier beads that seals the developer in the development unit.

SUMMARY OF THE INVENTION

According to one aspect of the present invention, there is provided an apparatus for applying toner particles to a charge-retentive surface, comprising a housing for retaining toner particles. A roll, defining a main surface having a length and a circumference, is rotatably mounted relative to the housing. A first portion of the length of the main surface of the roll is disposed to convey toner particles directly to the charge-retentive surface. A seal member is fixedly mounted relative to the housing, the seal member extending around at least a portion of the circumference over at least a second portion of the length of the main surface of the roll. The seal member is spaced a substantially even predetermined distance relative to the main surface of the roll. The seal member defines a plurality of magnetic poles therein.

According to another aspect of the present invention, there is provided an apparatus for applying toner particles to a charge-retentive surface, comprising a housing for retaining toner particles. A roll, defining a main surface having a length and a circumference, is rotatably mounted relative to the housing. A blade is mounted within the housing and urged against a portion of the main surface of the roll. A magnetic shim is disposed adjacent an end of the blade and adjacent an end of the roll, the magnetic shim defining therein a plurality of magnetic poles.

BRIEF DESCRIPTION OF THE DRAWINGS

In the drawings:

FIG. 1 is a sectional elevational view showing the basic elements of a xerographic development unit using single-component magnetic developer material, where the present invention could be implemented;

FIG. 2 is a sectional elevational view, through line 2—2 in FIG. 1, showing the configuration of a magnetic seal according to the present invention;

DETAILED DESCRIPTION OF THE INVENTION

Figure 3:
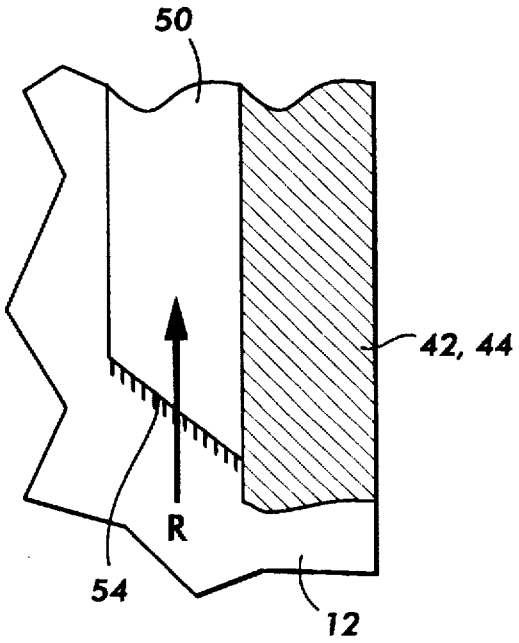
FIG. 3 is a sectional view, through line 3—3 in FIG. 1, showing a feature of the magnetic seal member according to a preferred embodiment of the present invention.

FIG. 1 is a sectional elevational view of a development unit that would be used, for example, to apply single-component developer or toner to an electrostatic latent image on a photoreceptor in an electrophotographic printing or copying apparatus. The development unit, generally indicated as 10, includes a housing 12, which retains a quantity of single-component developer or toner, the top level of which is indicated by the dotted line marked 14. The toner in this embodiment is expected to fill substantially the entire housing 12, or at least the toner level should be over the axle of the sleeve 20, which will be described below. As toner is consumed in the course of use of development unit 10, additional toner is typically supplied through an input port (not shown) connected to an external supply of toner.

Disposed within the housing 12 are a pair of augers 16, 18, which have the general function of distributing toner evenly along the length of a donor roll generally indicated as 20, which, as is known in the art, typically extends across a width of a moving photoreceptor drum or belt, a portion of which is shown as charge receptor 21, which forms an essential part of an electrostatographic printer or copier. The donor roll 20 includes an outer sleeve 22, typically made of phenolic, ceramic, or anodized aluminum, which rotates around a stationary magnetic assembly indicated as 24; in this way the rotation of sleeve 22 causes the conveyance of toner particles from housing 12 to an electrostatic latent image on charge receptor 21. Augers 16 and 18, along with sleeve 22 of donor roll 20, rotate at various speeds, typically through an arrangement of gears or pulleys (not shown) by which they are connected.

A charge/metering blade, here indicated as metering blade 30, is mounted to be urged against a portion of the sleeve 22 of donor roll 20. The metering blade 30 may also include some type of holder, such as indicated as 32, as well as a silicone pad 34, which directly contacts the sleeve 22 of donor roll 20.

FIG. 2 is another sectional elevational view, through line 2—2 shown in FIG. 1, showing a roll seal disposed toward one end of donor roll 20. As can be seen in FIG. 2, the sleeve 22 of donor roll 20 is mounted on an axle 26 which extends out of the housing 12, and is connected to some external source of mechanical energy (not shown). Disposed around axle 26 at the end of sleeve 22 is what is known as a "tracking roll" 40, which may be permitted to rotate independently on sleeve 22. Tracking roll 40 has a slightly larger radius than sleeve 22, and engages a surface of the photoreceptor, thereby enabling the bulk of the length of sleeve 22 to be evenly spaced from the photoreceptor. Tracking roll 40 is engaged by a foam pad extending most of the circumference therearound, portions of which are shown as 42 in the sectional view of FIG. 2. According to a preferred embodiment, the foam pads 42 can be covered with a low-friction s covering 44.

Also extending around at least a portion of the circumference of sleeve 22 at the end thereof is a magnetic seal indicated as 50, shown in two parts in the sectional view of the Figure. The magnetic seal 50 defines magnetic poles in distinct locations therein, such as by incorporating permanent magnet material in, for example, a flexible plastic. Each N or S magnetic pole within seal 50 extends around at least a portion of the circumference of sleeve 22, and the poles alternate along the length of sleeve 22.

According to a preferred embodiment of the present invention, magnetic seal 50 defines a uniform gap relative to the surface of sleeve 22, and this gap, indicated as 52 in the Figure, is preferably between 0.2 and 0.5 millimeters wide. In other words, gap 52 should be of a width from between 10 and 50, and more preferably between 20 and 50, times the median diameter of the toner particles, given a particular type of developer material; the illustrated embodiment is intended for single-component magnetic developer in which the toner particles are of a median diameter of 10 micrometers.

Gap 52 is of such a width that a turnover of toner particles in and out of the gap is developed as the sleeve 22 rotates, particularly if the toner level (shown as 14 in FIG. 1) is above the axle 26 or fills substantially the entire housing. The relatively large gap 52 creates substantially no normal force on toner particles caught therein, and therefore there is very little inter-particle friction of the toner churning in the gap 52. Because there is essentially no friction between particles in gap 52, there will be no significant heat generated in gap 52, and this in turn avoids agglomeration or "clumping" of toner particles within the bulk of the toner supply. The presence of the bands of magnetic poles in magnetic member 50 cause a reasonable quantity of magnetized toner particles to be retained in gap 52, and further substantially prevents leakage of these toner particles out of gap 52 and onto, for example, the areas around pads 42.

The overall design of the roll seal shown in FIG. 2 therefore satisfies both requirements of a roll seal, particularly in the context of using magnetic or MICR toners: outward leakage of toner particles is substantially prevented, and at the same time very little normal forces are applied to toner particles around the roll seal, which prevents the unwanted generation of heat around the roll seal.

FIG. 3 is a sectional view through the line marked 3—3 in FIG. 1, showing a feature of a preferred embodiment of the present invention. At the portion of magnetic member 50 toward the bottom of the donor roll 20, the magnetic member 50 forms a diagonal edge here indicated as 54. Because magnetic member 50 has a substantial thickness itself, diagonal edge 54 forms a slot against the "floor" of the housing 12. As sleeve 20 rotates, relative movement of the sleeve, shown as R in FIG. 3, will cause toner particles adhering to sleeve 22 to be caught in the slot formed by diagonal cut 54; the direction of diagonal cut 54 relative to rotational direction R is such that toner particles caught in the sleeve are funneled back into the bulk of the housing 12, and generally away from the pad 42 or its covering 44. This feature serves to further enhance the seal made by magnetic member 50.

Figure 4:
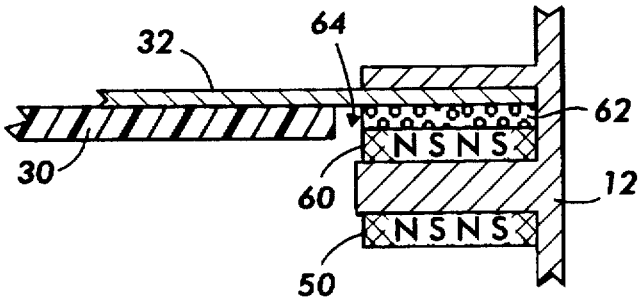
FIG. 4 is a sectional view, through line 4—4 in FIG. 1, showing a preferred type of mounting for a charge/metering blade according to another aspect of the present invention.

FIG. 4 is a sectional view through line 4-4 in FIG. 1, showing a detail of a mounting of the metering blade 30, according to a preferred embodiment of the present invention. As mentioned above, metering blade 30, which is used to allow charging and metering of toner particles attached to sleeve 22 of donor roll 20, is rigidly mounted within housing 12. In the embodiment illustrated in the Figure, the metering blade 30, which is typically made of spring steel, is attached to a blade holder 32, which at one or both ends thereof is mounted as shown to the rest of housing 12. According to a preferred embodiment of the present invention, the end of blade holder 32 is attached to a magnetic shim 60 and a shim of flexible foam rubber 62. Magnetic shim 60 includes the same bands of magnetic poles as does magnetic seal 50, described above.

Metering blade 30 is screwed, riveted, bonded, or otherwise firmly attached to blade holder 32. Because metering blade 30 must be precisely oriented relative to sleeve 22 of donor roll 20, a gap, hereshown as 64, is created between the end of metering blade 30 and another structure within the development unit. Gaps such as 64 can be important locations for mechanical stresses on toner, which once again can create the undesirable agglomeration of toner within the unit. The magnetic properties of magnetic shim 60 attract toner to the gap 64, to form a barrier preventing leakage of the toner through the gap. The magnetic shim 60 also allows for more tolerance between the end of metering blade 30 and other structures while eliminating the potential for either leakage or accumulation of toner. Since neither the magnetic shim 60 nor the foam rubber shim 62 are fibrous, the structure also eliminates any chance of fibers becoming dislodged and contaminating the toner supply.

While the invention has been described with reference to the structure disclosed, it is not confined to the details set forth, but is intended to cover such modifications or changes as may come within the scope of the following claims.

We claim:

1. An apparatus for applying toner particles to a charge-retentive surface, comprising:

a housing for retaining toner particles;

a roll, defining a main surface having a length and a circumference; rotatably mounted relative to the housing, a first portion of the length of the main surface of the roll being disposed to convey toner particles to the charge-retentive surface; and a seal member fixedly mounted relative to the housing, the seal member extending around at least a portion of the circumference over at least a second portion of the length of the main surface of the roll, the seal member being spaced a substantially even predetermined distance relative to the main surface of the roll, the seal member defining a plurality of magnetic poles therein, wherein the seal member defines a surface which is diagonal relative to a direction of rotation of the roll.

2. An apparatus for applying toner particles to a charge-retentive surface, comprising:

a housing for retaining toner particles;

a roll, defining a main surface having a length and a circumference, rotatably mounted relative to the housing, a first portion of the length of the main surface of the roll being disposed to convey toner particles to the charge-retentive surface;

a seal member fixedly mounted relative to the housing, the seal member extending around at least a portion of the circumference over at least a second portion of the length of the main surface of the roll, the seal member being spaced a substantially even predetermined distance relative to the main surface of the roll, the seal member defining a plurality of magnetic poles therein;

a blade urged against a portion of the main surface of the roll; and a mount for mounting the blade within the housing, said mount including a magnetic shim disposed adjacent an end of the roll, said magnetic shim defining therein a plurality of magnetic poles, said magnetic poles alternating along a direction parallel to the length of the roll.

3. The apparatus of claim 2, the mount including a blade holder attached to the blade, and the magnetic shim being disposed between the blade holder and a portion of the housing.

4. An apparatus for applying toner particles to a charge-retentive surface, comprising:

a housing for retaining toner particles;

a roll, defining a main surface having a length and a circumference, rotatably mounted relative to the housing;

a blade mounted within the housing and urged against a portion of the main surface of the roll; and a magnetic shim disposed adjacent an end of the blade and adjacent an end of the roll, said magnetic shim defining therein a plurality of magnetic poles, said magnetic poles alternating along a direction parallel to the length of the roll.

5. The apparatus of claim 4, further including a blade holder attached to the blade, and the magnetic shim being disposed between the blade holder and a portion of the housing.

* * * * *